US009815659B2

(12) United States Patent
Nomura

(10) Patent No.: US 9,815,659 B2
(45) Date of Patent: Nov. 14, 2017

(54) REEL SUPPORT DEVICE

(71) Applicants: FUJI SEIKO CO., LTD., Hashima-Shi, Gifu-Ken (JP); FUJI SHOJI CO., LTD., Hashima-Shi, Gifu-Ken (JP)

(72) Inventor: Shigeaki Nomura, Hashima (JP)

(73) Assignees: FUJI SEIKO CO., LTD. (JP); FUJI SHOJI CO., LTD. (JP)

( * ) Notice: Subject to any disclaimer, the term of this patent is extended or adjusted under 35 U.S.C. 154(b) by 0 days.

(21) Appl. No.: 15/119,588

(22) PCT Filed: Feb. 26, 2014

(86) PCT No.: PCT/JP2014/054703
§ 371 (c)(1),
(2) Date: Aug. 17, 2016

(87) PCT Pub. No.: WO2015/128968
PCT Pub. Date: Sep. 3, 2015

(65) Prior Publication Data

US 2017/0050818 A1 Feb. 23, 2017

(51) Int. Cl.

| | |
|---|---|
| ***B65H 49/32*** | (2006.01) |
| ***B65H 49/34*** | (2006.01) |
| ***B65H 49/36*** | (2006.01) |
| ***B65H 19/12*** | (2006.01) |
| ***B65H 49/24*** | (2006.01) |
| ***B65H 67/02*** | (2006.01) |

(52) U.S. Cl.
CPC ..... *B65H 49/324* (2013.01); *B65H 19/126* (2013.01); *B65H 49/24* (2013.01); *B65H 49/32* (2013.01); *B65H 49/34* (2013.01); *B65H 49/36* (2013.01); *B65H 67/02* (2013.01)

(58) Field of Classification Search
CPC ..... B65H 49/324; B65H 49/34; B65H 49/36; B65H 67/02; B65H 19/126; B65H 16/06; B65H 54/553
USPC ..... 242/596.4–596.6
See application file for complete search history.

(56) References Cited

U.S. PATENT DOCUMENTS

2002/0130214 A1* 9/2002 Nakamura ..... B65H 16/06 242/559.2

FOREIGN PATENT DOCUMENTS

| | | | |
|---|---|---|---|
| JP | 62-173347 U | | 11/1987 |
| JP | 10-338420 A | | 12/1998 |
| JP | 2007-091450 A | | 4/2007 |
| JP | 2009-285939 A | | 12/2009 |
| JP | 2010214405 A | * | 9/2010 |
| WO | 2009/119240 A1 | | 10/2009 |

OTHER PUBLICATIONS

Machine Translation of WO 2009/119240 A1, Oct. 1, 2009.*

(Continued)

*Primary Examiner* — William E Dondero
(74) *Attorney, Agent, or Firm* — Tarolli, Sundheim, Covell & Tummino, LLP

(57) ABSTRACT

Disclosed is a reel support device including a separation member that separates a reel from a floor surface as the reel rolls and a support member that supports the reel at a separated position so that the reel is rotatable about its center.

9 Claims, 5 Drawing Sheets

(56) References Cited

OTHER PUBLICATIONS

Machine Translation of JP 2010-214405 A, Sep. 30, 2010.*
International Search Report for Application No. PCT/JP2014/054703 dated May 27, 2014.
International Preliminary Report on Patentability for Application No. PCT/JP2014/054703 dated May 27, 2014.

* cited by examiner

REEL SUPPORT DEVICE

RELATED APPLICATIONS

The present invention is a U.S. National Stage under 35 USC 371 patent application, claiming priority to Serial No. PCT/JP2014/054703, filed on 26 Feb. 2014; the entirety of which is incorporated herein by reference.

TECHNICAL FIELD

The present invention relates to a support device that supports a reel for storing a linear body, such as a wire.

BACKGROUND ART

Patent document 1 discloses a reel around which wire is wound for storage. The reel of patent publication 1 is arranged on a device that forms a bead wire of a tire. Wire fed to the bead wire former is wound around the reel.

PRIOR ART DOCUMENT

Patent Document

Patent Document 1: Japanese Laid-Open Patent Publication No. 2009-285939

SUMMARY OF THE INVENTION

Problems that are to be Solved by the Invention

In a process that uses the reel, a large amount of wire is stored on the reel to allow for continuous operation. This enlarges the reel and greatly increases the weight especially when the wire is made of metal. Thus, it takes time to replace the reel even when using a large device like a crane.

It is an object of the present invention to provide a reel support device that has a simple structure and allows the reel to be replaced within a short period of time.

Means for Solving the Problems

To achieve the above object, the present invention provides a reel support device including a separation member that separates a reel from a floor surface as the reel rolls and a support member that supports the reel at a separated position so that the reel is rotatable about its center.

When the reel is separated from the floor surface by the separation member, the reel becomes rotatable at the separated position. Thus, the linear body can easily be wound around the reel or easily let out from the reel. After completing a task, the reel may be returned from the separated position onto the floor surface and moved on the floor. This facilitates the replacement of the reel.

Further, since the reel can be moved, the structure may be compact and simple.

Effect of the Invention

The present invention succeeds in providing a reel support device that has a simple structure and allows the reel to be replaced within a short period of time.

MODES FOR CARRYING OUT THE INVENTION

A reel support device according to one embodiment of the present invention will now be described.

Figure 1:
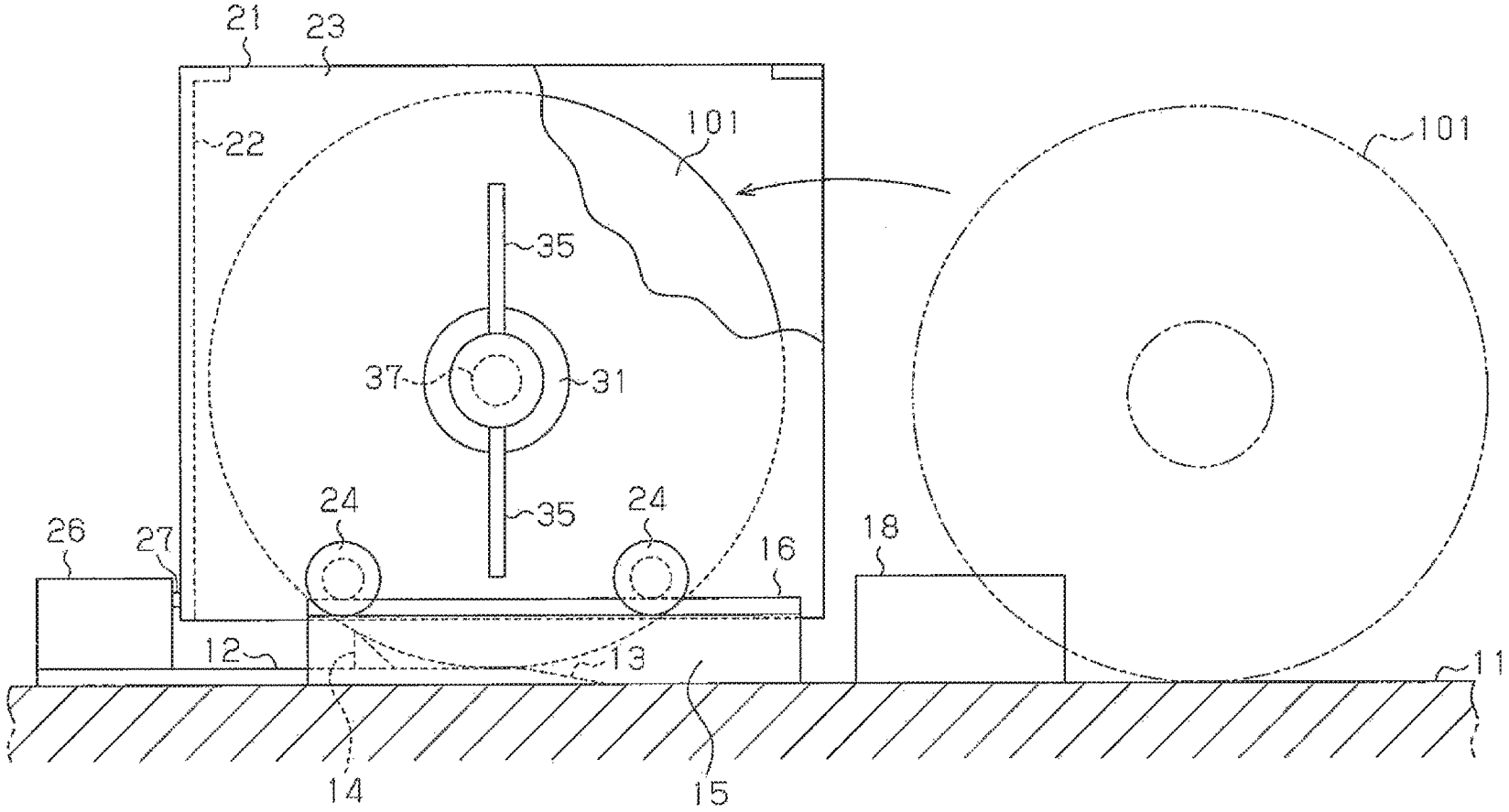
FIG. 1 is a side view of a reel support device according to an embodiment of the present invention showing a state in which a reel base is located at a first position.
Figure 2:
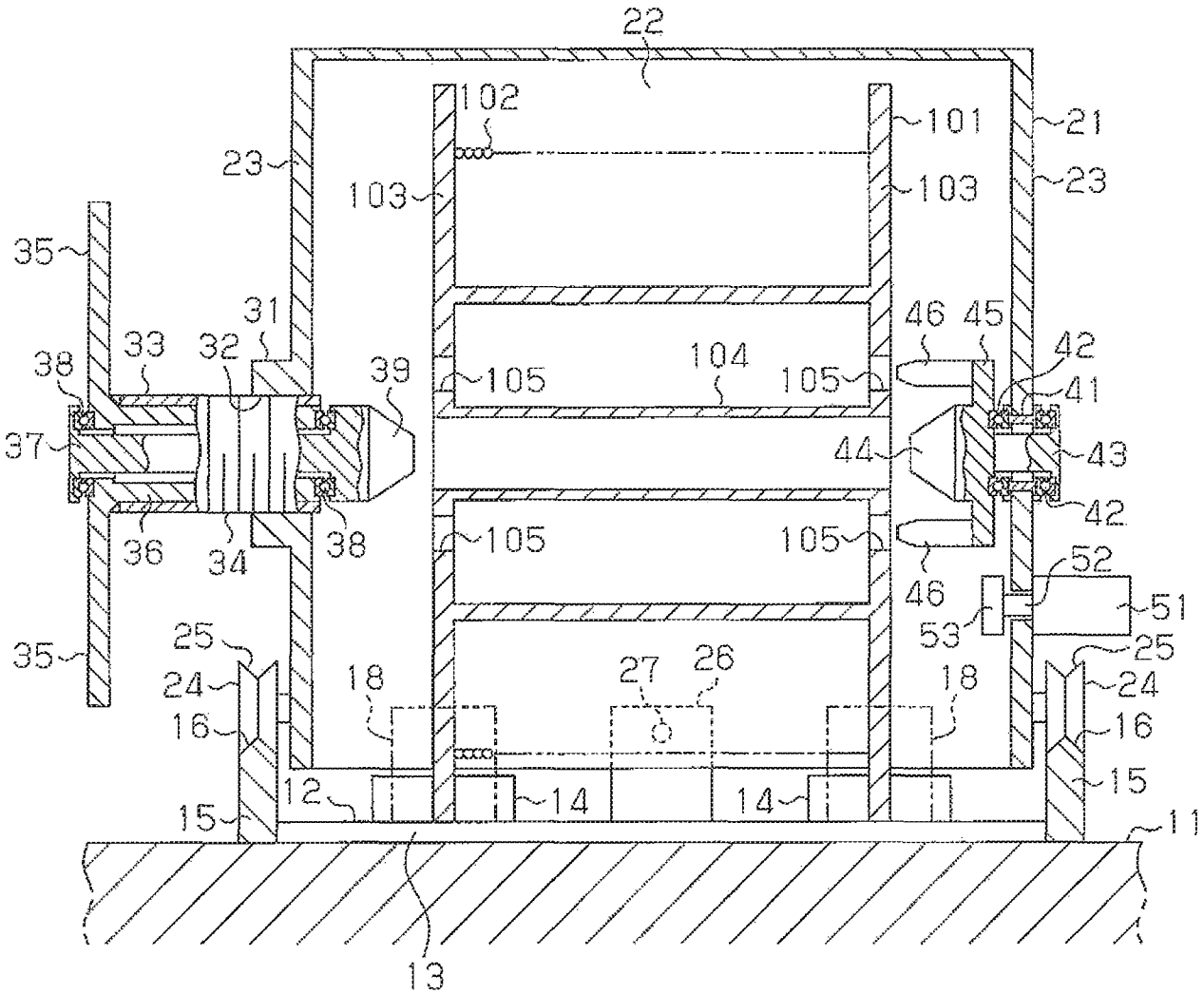
FIG. 2 is a cross-sectional view of the reel support device and a reel showing a state before the center of the reel is supported.

As shown in FIGS. 1 and 2, a holding plate 12 is fixed to a floor surface 11. The holding plate 12 forms a separation member that lifts and separates a reel 101 from the floor surface 11. The rear end of the holding plate 12 includes a slope 13. The upper surface of the holding plate 12 defines a reel holding surface that is continuous with the slope 13. Stoppers 14 are fixed to the front end of the upper surface of the holding plate 12. The left side as viewed in FIG. 1 is the front, and the right side as viewed in FIG. 1 is the rear.

Rails 15 are fixed to the floor surface 11 at opposite sides of the holding plate 12. The upper end of each rail 15 defines a guide surface 16, which has the form of a ridge (reversed V-shaped cross section).

Figure 5:
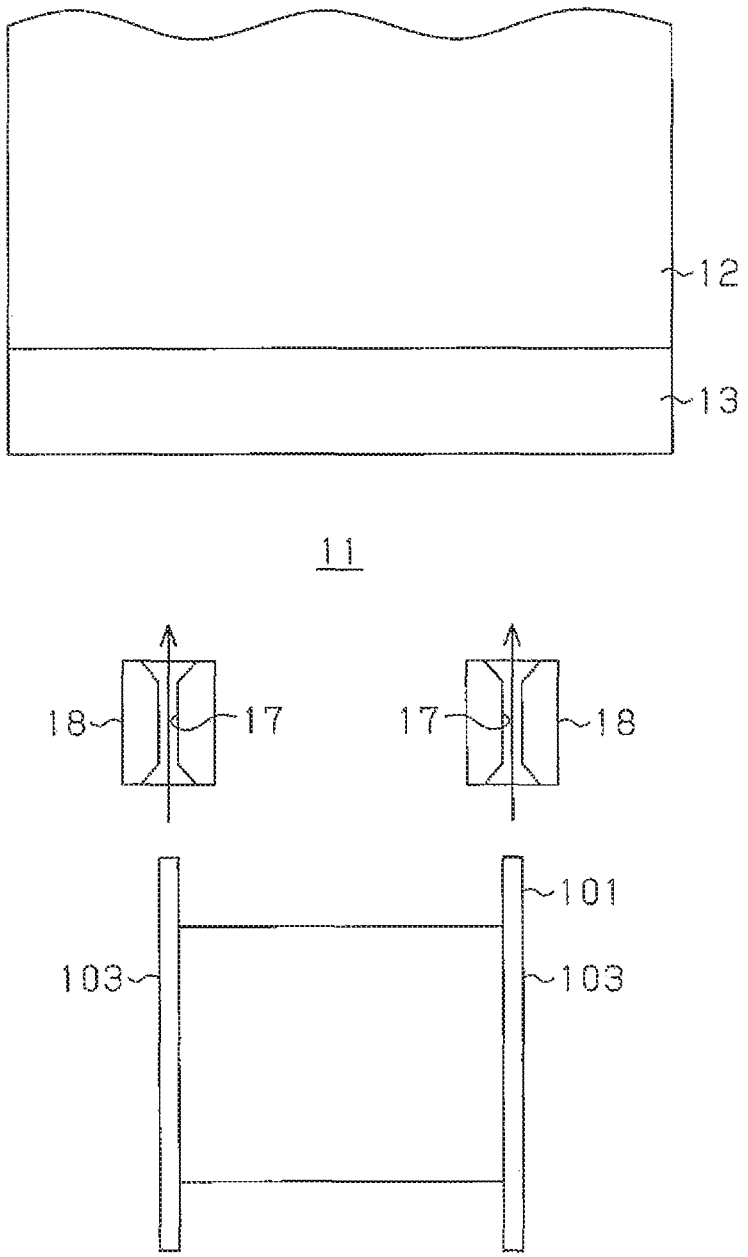
FIG. 5 is a schematic plan view showing a state before the reel is placed on a holding plate.

As shown in FIGS. 1 and 5, two guide members 18, each including a guide groove 17, are fixed to the floor surface 11 at the rear of the holding plate 12 and the rails 15.

As shown in FIGS. 1 and 2, a reel base 21 that is capable of accommodating the reel 101 includes a front plate 22, two side plates 23, an open rear portion, and an open lower portion. The two side plates 23 are each provided with front and rear wheels 24. The wheels 24 are arranged so that they can roll on the rails 15. Accordingly, the reel base 21 is movable toward the front and rear in the extending direction of the rails 15. Each wheel 24 has an outer circumferential surface defining a rolling surface 25 that is recessed so as to be fitted to the guide surface 16. A drive member 26, which is formed by an air cylinder and fixed to the floor surface 11, includes a piston rod 27 coupled to the front plate 22 of the reel base 21. The projection and retraction of the piston rod 27 moves the reel base 21 between a first position, which is located at the front side and corresponds to the reel holding surface of the holding plate 12, and a second position, which is separated toward the rear from the reel holding surface.

Figure 3:
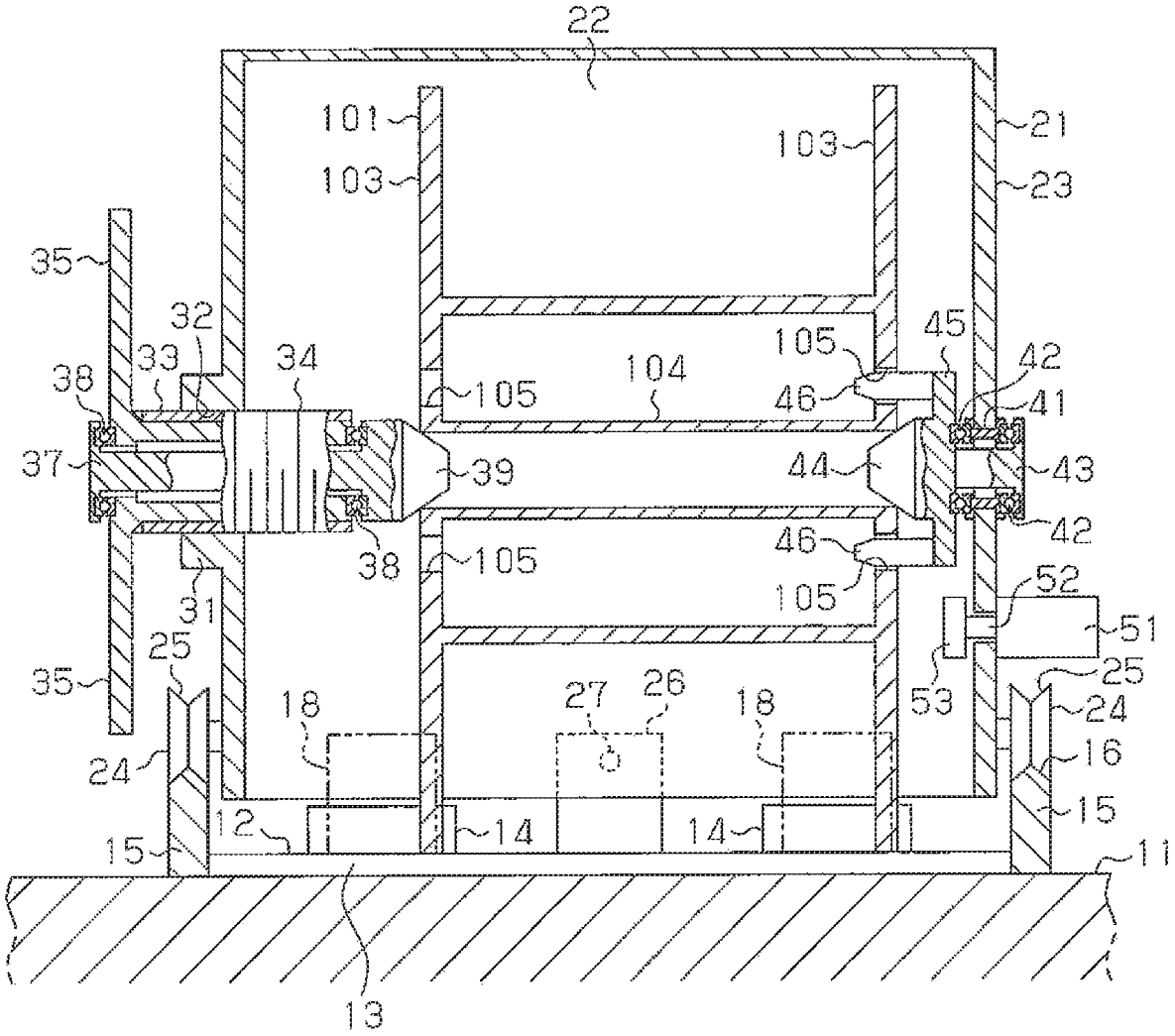
FIG. 3 is a cross-sectional view of the reel support device and the reel showing a state when the center of the reel is supported.

As shown in FIGS. 2 and 3, the central portion of one of the side plates 23 in the reel base 21 includes a boss 31, which includes an inner circumferential surface that defines a female thread 32. An outer tube 33 having an outer circumferential surface that defines a male thread 34 is fastened to the female thread 32. A cylindrical hollow shaft 36 of a handle 35 is fitted into and fixed to the outer tube 33. Accordingly, the handle 35 rotates integrally with the outer tube 33. A retaining shaft 37 is supported in the hollow shaft 36 by a bearing 38 so as to be rotatable relative to the hollow shaft 36. The distal end of the retaining shaft 37 defines a tapered portion 39.

A support tube 41 is fixed to the other side plate 23 of the reel base 21. A receiving shaft 43 is rotationally supported in the support tube 41 by a bearing 42 and positioned coaxially with the retaining shaft 37. The distal end of the receiving shaft 43 defines a tapered portion 44 that is opposed to the tapered portion 39 of the retaining shaft 37.

The receiving shaft 43 includes a distal portion defining a stay 45. Coupling pins 46 are fixed to the stay 45.

A pushing member 51, which is formed by an air cylinder, is fixed to the side plate 23 below the support tube 41. A piston rod 52 of the pushing member 51 includes a distal end that defines a flanged pushing portion 53.

The operation of the device described above will now be described.

The double-dashed lines in FIG. 1 shows a state before the reel 101 is accommodated in the reel base 21. In this state, the piston rod 27 of the drive member 26 is retracted, and the reel base 21 is located at a forward position.

From this state, the reel 101, around which a linear body 102 is wound, is rolled into the reel base 21 from the rear open portion of the reel base 21. As shown in FIG. 5, flanges 103 of the reel 101 pass through the guide grooves 17 of the guide members 18 on the floor surface 11. This restricts the position of the reel 101 in the left and right directions. Thus, the reel 101 is located on a predetermined entrance line directed toward the holding plate 12. The reel 101 is moved from the slope 13 to a predetermined position in the reel holding surface on the holding plate 12 and stopped by the stopper 14.

When the reel 101 is located on the holding plate 12, the reel 101 is separated by an amount corresponding to the thickness of the holding plate 12 from the floor surface 11 and located above the floor surface 11.

In this manner, when the reel 101 is located above the floor surface on the holding plate 12, an operator operates the handle 35 so that the threads 32 and 34 function to move the outer tube 33 and the hollow shaft 36 toward the reel 101. The tapered portion 39 of the retaining shaft 37 is fitted into one end of a center tube 104 of the reel 101 and coupled to the center tube 104 (refer to FIGS. 2 and 3). Further operation of the handle 35 further moves the outer tube 33 and the retaining shaft 37. This moves the reel 101 together with the outer tube 33 and the retaining shaft 37 so that the other end of the center tube 104 is fitted to the tapered portion 44 of the receiving shaft 43, and the center tube 104 is coupled to the tapered portion 44. Further, the coupling pins 46 are fitted into coupling bores 105 of the reel flange 103.

Figure 4:
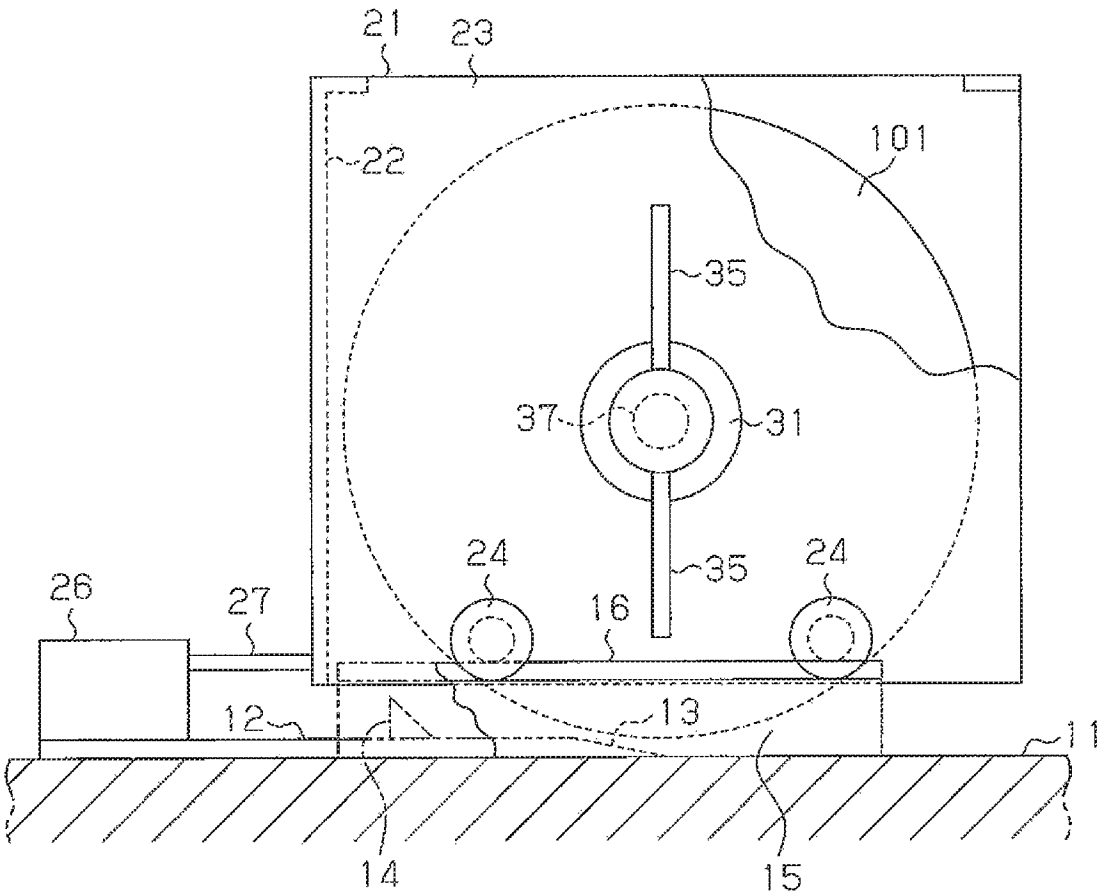
FIG. 4 is a side view of the reel support device showing a state in which the reel base is located at a second position.

In this state, the reel 101 is supported by the shafts 37 and 43. Thus, the shafts 37 and 43 form a shaft support that supports the reel 101. In this state, as shown in FIG. 4, the piston rod 27 of the drive member 26 is projected. Thus, the reel base 21 is moved backward on the rails 15 to the second position, and the reel 101 is moved together with the reel base 21. The movement separates the reel 101 from the reel holding surface on the holding plate 12 with the reel 101 lifted from the floor surface 11. Accordingly, the left and right shafts 37 and 43 support the center of the reel 101 so that the reel 101 is rotatable about the center. Thus, the shafts 37 and 43 form a support member that rotationally supports the reel 101.

In this state, the reel 101 can be rotated to let out the linear body, such as a wire, from the reel 101. Accordingly, the wire may be used to manufacture a product.

When the linear body is completely let out from the reel 101 and the reel 101 becomes empty, the procedures described above are reversed to move the reel 101 out of the reel base 21.

More specifically, the piston rod 27 of the drive member 26 is retracted to return the reel base 21 from the second position to the first position shown in FIG. 1 so that the reel 101 moves onto the reel holding surface of the holding plate 12. In this state, the handle 35 is operated to separate the tapered portion 39 of the shaft 37 away from the center tube 104 of the reel 101. Then, the piston rod 52 of the pushing member 51 is projected to move the reel 101 to the position shown in FIG. 2 with the pushing portion 53. Thus, the tapered portion 44 of the shaft 43 is separated from the center tube 104, and the coupling bores 105 are separated from the coupling pins 46. Further, the flanges 103 of the reel 101 are opposed to the guide grooves 17 of the guide members 18.

In this state, the empty reel 101 can be rolled and moved out of the reel base 21. The reel 101 may be replaced in this manner.

The above embodiment has the advantages described below.

The reel 101 is accommodated in the reel base 21 from the rear open portion of the reel base 21 at the first position, and the reel 101 is moved onto the holding plate 12. In this state, the reel 101 is coupled to the shafts 37 and 43, and the reel base 21 is moved to the second position so that the reel 101 moves off the holding plate 12. This lifts the reel 101 from the floor surface 11 to be rotatable at that position. Accordingly, the linear body can easily be let out from the reel 101. After completing a task, the reel base 21 is moved in the reverse direction onto the holding plate 12 and disconnected from the shafts 37 and 43. Then, the reel 101 is moved from the holding plate 12 to the floor surface 11 and out of the reel base 21. Thus, by mainly rolling the reel 101 and moving the reel base 21, the reel 101 can easily be replaced without using a large device such as a crane.

Further, in the reel support device, the box-shaped reel base 21 is supported by the rails 15. Further, the reel support device only includes the drive member 26, which is formed by an air cylinder to move the reel base 21, and the pushing member 51, which is formed by an air cylinder to push the reel base 21. This allows the reel support device to have a compact and simple structure and does not require a large device such as a crane.

The reel 101 that is rolled to be accommodated in the reel base 21 is guided by the guide members 18 on the entrance line leading to the holding plate 12. Accordingly, the reel 101 can be accurately accommodated at a predetermined position in the reel base 21, and the accommodation task can be efficiently performed.

The above embodiment may be modified as described below.

For example, the drive member 26 that moves the reel base 21 may be omitted. In such a case, the reel base 21 is manually moved in the front and rear directions.

The drive member 26 may be an actuator other than an air cylinder, such as a hydraulic cylinder or a motor.

The reel base 21 may include a reel rotation motor. In addition to letting out a linear body from the reel 101, this allows a linear body to be wound around the reel 101.

Instead of the holding plate 12, two narrow plates may be laid out in correspondence with the flanges 103 of the reel 101.

Instead of wheels, the reel base 21 may use anything that slides on rails.

DESCRIPTION OF REFERENCE CHARACTERS

11: floor surface, 12: holding plate, 13: slope, 15: rails, 21: reel base, 26: drive member, 37: retaining shaft, 40: receiving shaft, 51: pushing member.

The invention claimed is:

1. A reel support device comprising:

a separation member that separates a reel from a floor surface as the reel rolls; and a support member that moves parallel to the floor surface and supports the reel at a separated position so that the reel is rotatable about its center.

2. The reel support device according to claim 1, wherein the separation member is a holding plate arranged on the floor surface, and the holding plate includes a slope and a reel holding surface that is continuous with the slope.

3. The reel support device according to claim 1, wherein the support member is moved along a rail.

4. The reel support device according to claim 1, wherein the support member is movable between a first position that corresponds to a reel holding surface of the separation member and a second position that is separated from the first position.

5. The reel support device according to claim 4, further comprising a drive member that moves the support member between the first position and the second position.

6. The reel support device according to claim 1, wherein the support member includes a shaft support that is movable between a position where the shaft support supports the center of the reel and a position separated from that position.

7. The reel support device according to claim 6, wherein the support member includes a pushing member that pushes the reel supported by the shaft support.

8. The reel support device according to claim 1, further comprising a guide member that guides the reel toward a predetermined position in the support member.

9. A reel support device comprising:

a separation member arranged on a floor surface and including a slope that separates a reel from the floor surface as the reel rolls and a reel holding surface that is continuous with the slope;

a support member that moves parallel to the floor surface and supports the reel to be rotatable about its center when the reel is separated from the floor, wherein the support member is movable along a rail between a first position that corresponds to the reel holding surface of the separation member and a second position that is separated from the first position;

a drive member that moves the support member between the first position and the second position;

a shaft support arranged in the support member, wherein the shaft support is movable between a position where the shaft support supports the center of the reel and a position separated from that position;

a pushing member arranged in the support member, wherein the pushing member pushes the reel that is supported by the shaft support; and a guide member that guides the reel toward a predetermined position in the support member.

* * * * *